US007319203B1

(12) United States Patent
Briggs et al.

(10) Patent No.: US 7,319,203 B1
(45) Date of Patent: Jan. 15, 2008

(54) CIRCUIT INTERRUPTER AND OPERATING MECHANISM THEREFOR

(75) Inventors: Roger J. Briggs, Colgate, WI (US); Paul J. Rollmann, Brown Deer, WI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/621,620

(22) Filed: Jan. 10, 2007

(51) Int. Cl.
*H01H 3/00* (2006.01)

(52) U.S. Cl. ..... 200/400; 200/17 R; 200/401; 200/500; 200/501

(58) Field of Classification Search ..... 200/17 R, 200/400, 401, 500, 501; 218/154; 335/171–179
See application file for complete search history.

(56) References Cited

U.S. PATENT DOCUMENTS

| | | | | |
|---|---|---|---|---|
| 4,162,385 | A * | 7/1979 | Bould et al. | 200/400 |
| 5,584,383 | A * | 12/1996 | Matsuo et al. | 200/400 |
| 5,864,106 | A | 1/1999 | Hartwig et al. | |
| 6,015,959 | A * | 1/2000 | Slepian et al. | 200/400 |
| 6,064,021 | A * | 5/2000 | Wehrli et al. | 200/400 |
| 6,066,820 | A * | 5/2000 | Niklaus | 200/501 |
| 6,472,627 | B1 * | 10/2002 | Yoon | 200/400 |
| 6,563,067 | B2 * | 5/2003 | Ohtsuka et al. | 200/400 |
| 6,610,949 | B2 * | 8/2003 | Mori et al. | 200/400 |
| 6,809,279 | B2 * | 10/2004 | Allmen | 200/501 |
| 6,831,244 | B2 * | 12/2004 | Kawamoto et al. | 218/78 |
| 6,917,006 | B2 * | 7/2005 | Bachofen | 200/400 |
| 7,009,130 | B2 * | 3/2006 | Hashimoto et al. | 200/400 |

OTHER PUBLICATIONS

Gruner, "Battery Disconnect Relay," pp. 1-2.

Tyco Electronics, "Lev200 Series Contractor with 1 Form X (SPST-NO-DM) Contacts Rated 500 + Amps, 12-900VDC," 2005, Catalog 9-1773439-1, issued Jun. 2005.

BLI International, "Priority Start!® Starting is the Priority!", 2006, 2 pp.

Curtis Instruments, Inc., "Curtis/Albright Battery Disconnect Switches" ED150 Series, www.curtisinstruments.com, 2006, 1 p.

Cole Hersee Company, "Cole Facts Battery Selector & Master Disconnect Switches", http://www.colehersee.com, 2006, 2 pp.

Curtis Instruments, Inc., "DC Contactors And Disconnect Switches", 2006, 3 pp.

(Continued)

*Primary Examiner*—Michael A Friedhofer
(74) *Attorney, Agent, or Firm*—Martin J. Moran

(57) ABSTRACT

An operating mechanism is provided for a circuit interrupter, such as a battery disconnect apparatus, including a housing and a number of stationary electrical contacts enclosed by the housing. The operating mechanism includes a cam member having a profile with first and second portions. A movable contact assembly includes at least one movable electrical contact, and is cooperable with the cam member to move the movable electrical contact into and out of electrical contact with the stationary electrical contacts. An actuating assembly pivots the cam member between a first position corresponding to the first portion of the profile maintaining the movable electrical contact in electrical contact with the stationary electrical contacts, and a second position corresponding to the second portion of the profile releasing the movable contact assembly in order that the movable electrical contact is movable out of electrical contact with the stationary electrical contacts.

22 Claims, 4 Drawing Sheets

OTHER PUBLICATIONS

Connector Concepts, Inc., "Curtis/Albright enGage III™", 2006,2 pp.
Delphi, "Electrical/Electronic Distribution Systems", www.delphi.com, 2004, 8 pp.
Delphi, "Battery Disconnect System", www.delphi.com, 2006, 1 p.
Control Devices, Inc., 1 First Technology Innovative Solutions, Automotive & Special Products Division, "Battery Cut Off (BCO)", 2006, 2 pp.
Intellitec, "Intellitec Battery Disconnect Relay", 2006, 1 p.
Tyco Electronics Corporation, "EV200 Series Contactor With 1 Form A (SPST-NO) Contacts Rated 500+Amps, 12-900VDC", 2004, http://relays.tycoelectronics.com/datasheets/ev200.pdf, 2 pp.
BLI International, "Priority Start Priority Start Stop a dead battery before it happens!",2006, 2 pp.
Galactic Headquarters, "Battery Disconnect for Remote Controls", 2006, 1 p.
Mabuchi Motor Co., Ltd., "FC-280SC", 1 p.
Bicron Electronics Company, "SD0730N", 1 p.

* cited by examiner

CIRCUIT INTERRUPTER AND OPERATING MECHANISM THEREFOR

BACKGROUND OF THE INVENTION

1. Field of the Invention

The invention relates generally to circuit interrupters and, more particularly, to operating mechanisms for battery disconnect apparatus.

2. Background Information

Circuit interrupters such as, for example, battery disconnect switches, are employed to provide protection for the electrical power circuit of a vehicle. For example, some vehicles, such as trucks and cars, employ direct current (DC) disconnecting switches to provide a rapid mechanism to disconnect batteries or other DC power supplies in the event of serious electrical faults. Disconnecting switches may also be employed by vehicles such as, for example, electric vehicles such as golf carts and fork lifts, to disconnect alternating current (AC) power supplies.

Battery cable circuit protection devices, such as battery disconnect devices (BDDs) and battery cut off switches (BCOs), are known to be employed, for example, to disconnect the electrical system (e.g., without limitation, 12 VDC; any suitable DC or AC voltage) of the vehicle in response to a significant collision, or for maintenance during periods of inactivity. Such devices typically employ an operating mechanism having a movable electrical contact which is moved into and out of electrical contact with a number of stationary electrical contacts electrically connected to the battery cable. The movable electrical contact sometimes has a tendency to undesirably separate from the stationary electrical contact(s) when the vehicle is subjected to various shock and vibration loads (e.g., without limitation, rough terrain; pot holes; sudden stops; abrupt turns; collisions). Among other disadvantages, such unintentional separation of the electrical contacts presents an arcing hazard.

Prior proposals have attempted to accommodate such loads by employing an operating mechanism for the battery disconnect device which, for example, has an arrangement of springs, levers and/or solenoids. However, such designs are relatively complex, and thus expensive. Additionally, if the movable electrical contact is brought into electrical contact with the stationary electrical contact(s) too rapidly, it can undesirably bounce with respect to the stationary electrical contact(s), resulting in the undesirable arcing hazard noted above. Solenoids are generally fast-acting and can produce this undesirable result if utilized improperly. Solenoids can also be relatively large, heavy and expensive.

There is a need, therefore, for an improved operating mechanism for battery disconnect apparatus which not only provides resistance to arcing hazards caused, for example, by unintentional separation of the electrical contacts of the apparatus, but which is also relatively small, lightweight and cost-effective.

There is, therefore, room for improvement in battery disconnect apparatus and in operating mechanisms therefor.

SUMMARY OF THE INVENTION

These needs and others are met by embodiments of the invention, which provide an operating mechanism for a circuit interrupter, such as a battery disconnect apparatus, wherein the operating mechanism employs a cam member to resist the separable electrical contacts of the battery disconnect apparatus from separating unintentionally, for example, in response to shock and vibration loads which are commonly experienced by a vehicle.

As one aspect of the invention, an operating mechanism is provided for a circuit interrupter, which includes a housing and a number of stationary electrical contacts enclosed by the housing. The operating mechanism comprises: a cam member structured to be pivotably coupled to the housing, the cam member having a profile, the profile having a first portion and a second portion; a movable contact assembly comprising a movable electrical contact, the movable contact assembly being structured to cooperate with the cam member in order to move the movable electrical contact into and out of electrical contact with the number of stationary electrical contacts; and an actuating assembly structured to pivot the cam member between a first position corresponding to the first portion of the profile being structured to maintain the movable electrical contact of the movable contact assembly in electrical contact with the number of stationary electrical contacts, and a second position corresponding to the second portion of the profile being structured to release the movable contact assembly in order that the movable electrical contact is movable out of electrical contact with the number of stationary electrical contacts.

The first portion of the profile may have a first radius, and the second portion of the profile may have a second radius, wherein the first radius is greater than the second radius, and wherein the profile comprises a step from the first radius to the second radius. The movable contact assembly may further comprise at least one biasing element structured to bias the movable electrical contact away from the number of stationary electrical contacts. When the cam member is moved from the first position toward the second position, the step of the profile may be structured to enable such biasing element to move the movable contact assembly toward the second portion of the profile, in order to move the movable electrical contact away from the number of stationary electrical contacts. The movable contact assembly may further comprise a movable member, wherein the biasing element is disposed between the movable electrical contact and the movable member and the movable member is disposed between the biasing element and the cam member. The biasing element and the movable member may be structured to resist the movable electrical contact from bouncing with respect to the number of stationary electrical contacts.

The actuating assembly may comprise at least one actuator and a latch. The latch may include a first end and a second end. The latch may be structured to move linearly, or it may include a pivot and be pivotably coupled to the housing. The pivot may be disposed at or about the first end, or between the first end and the second end. When the cam member is disposed in the first position, the first end of the latch may engage the profile at or about the step, thereby preventing the cam member and the movable contact assembly from moving. Such actuator may be structured to move the second end of the latch, thereby pivoting the latch about the pivot in order to disengage the first end of the latch from the profile and to permit the cam member to pivot.

The at least one actuator may comprise a solenoid including a plunger, wherein the plunger is coupled to the latch at or about the second end of the latch, and wherein the solenoid is structured to move the plunger, thereby moving the first end of the latch out of engagement with the profile. The at least one actuator may further comprise a motor, and the actuating assembly may further comprise a plurality of gears. A corresponding one of the gears may be coupled to the motor, and each of the gears may have a plurality of teeth. In response to movement of such corresponding one of the gears by the motor, the teeth may be cooperable in order that all of the gears are movable. The gears may comprise a drive gear coupled to the motor, a cam gear coupled to the cam member, and a number of reduction gears disposed intermediate the drive gear and the cam gear. The cam gear may have a perimeter, wherein a portion of the perimeter of the cam gear is devoid of the teeth. When the cam member is disposed in the first position, the portion of the perimeter of the cam gear, which is devoid of the teeth, may be structured to disengage the cam gear and the cam member from the number of reduction gears, the drive gear and the motor. When the cam member is disposed in the second position, the teeth of the cam gear may be engagable with the teeth of a corresponding one of the number reduction gears, in order that the motor is movable to move the drive gear, the corresponding one of the number of reduction gears, and the cam gear, thereby moving the first portion of the profile of the cam member into engagement with the movable contact assembly to reset the battery disconnect apparatus.

As another aspect of the invention, a circuit interrupter comprises: a housing; separable contacts enclosed by the housing, the separable contacts including a number of stationary electrical contacts and at least one movable electrical contact; and an operating mechanism comprising: a cam member pivotably coupled to the housing, the cam member having a profile, the profile having a first portion and a second portion, a movable contact assembly cooperable with the cam member in order to move the movable electrical contact into and out of electrical contact with the number of stationary electrical contacts, and an actuating assembly structured to pivot the cam member between a first position corresponding to the first portion of the profile maintaining the movable electrical contact of the movable contact assembly in electrical contact with the number of stationary electrical contacts, and a second position corresponding to the movable contact assembly being releasable by the second portion of the profile in order that the movable electrical contact is movable out of electrical contact with the number of stationary electrical contacts.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
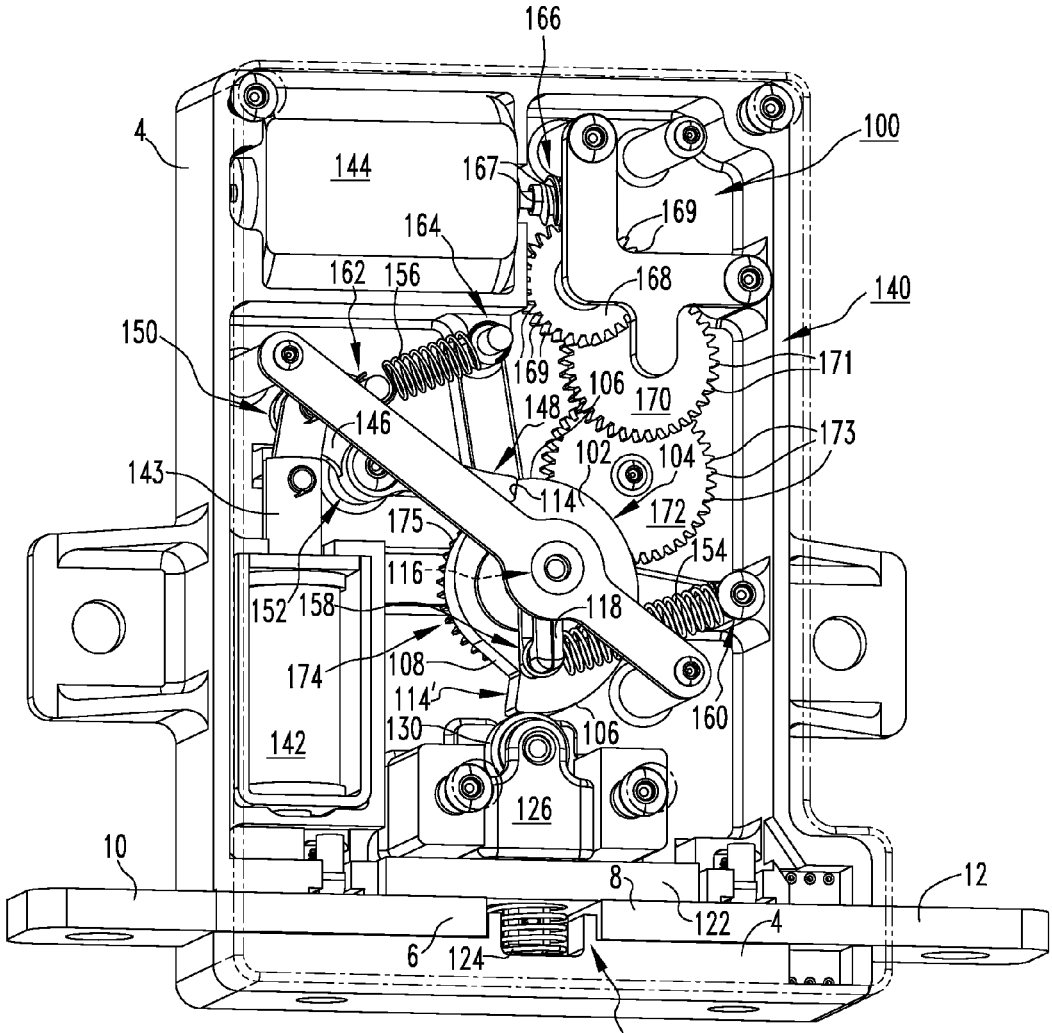
FIG. 1 is an isometric view of a battery disconnect apparatus and operating mechanism therefor in accordance with an embodiment of the invention, showing the operating mechanism in the closed position and the cover of the housing in phantom line drawing.

The invention is described in association with a battery disconnect apparatus for a vehicle, although the invention is applicable to a wide range of circuit interrupters for direct current (DC) (e.g., without limitation, 12 VDC; 24 VDC; 42 VDC; 60 VDC; any suitable direct current voltage) or alternating current (AC) powered systems.

Directional phrases used herein, such as, for example, left, right, top, bottom, upper, lower, front, back, clockwise, counterclockwise and derivatives thereof, relate to the orientation of the elements shown in the drawings and are not limiting to the claims unless expressly recited therein.

As employed herein, the term "vehicle" shall expressly include, but not be limited by, a land vehicle, a marine vehicle, an air vehicle or another motor vehicle.

As employed herein, the term "land vehicle" shall expressly include, but not be limited by, any land-based vehicles having pneumatic tires, any rail-based vehicles, any maglev vehicles, automobiles, cars, trucks, station wagons, sport-utility vehicles (SUVs), recreational vehicles, construction vehicles, off road vehicles, all-terrain vehicles, farm vehicles, fleet vehicles, motor homes, vans, buses, motorcycles, mopeds, campers, trailers, or bicycles.

As employed herein, the term "marine vehicle" shall expressly include, but not be limited by, any water-based vehicles, ships, boats, other vessels for travel on water, submarines, or other vessels for travel under water.

As employed herein, the term "air vehicle" shall expressly include, but not be limited by, any air-based vehicles, airplanes, jets, aircraft, airships, balloons, blimps, or dirigibles.

As employed herein, the terms "fastener" and "fastening mechanism" refer to any suitable connecting or tightening material or device expressly including, but not limited to, screws, bolts and the combinations of bolts and nuts (e.g., without limitation, lock nuts) and bolts, washers (e.g., without limitation, lock washers) and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
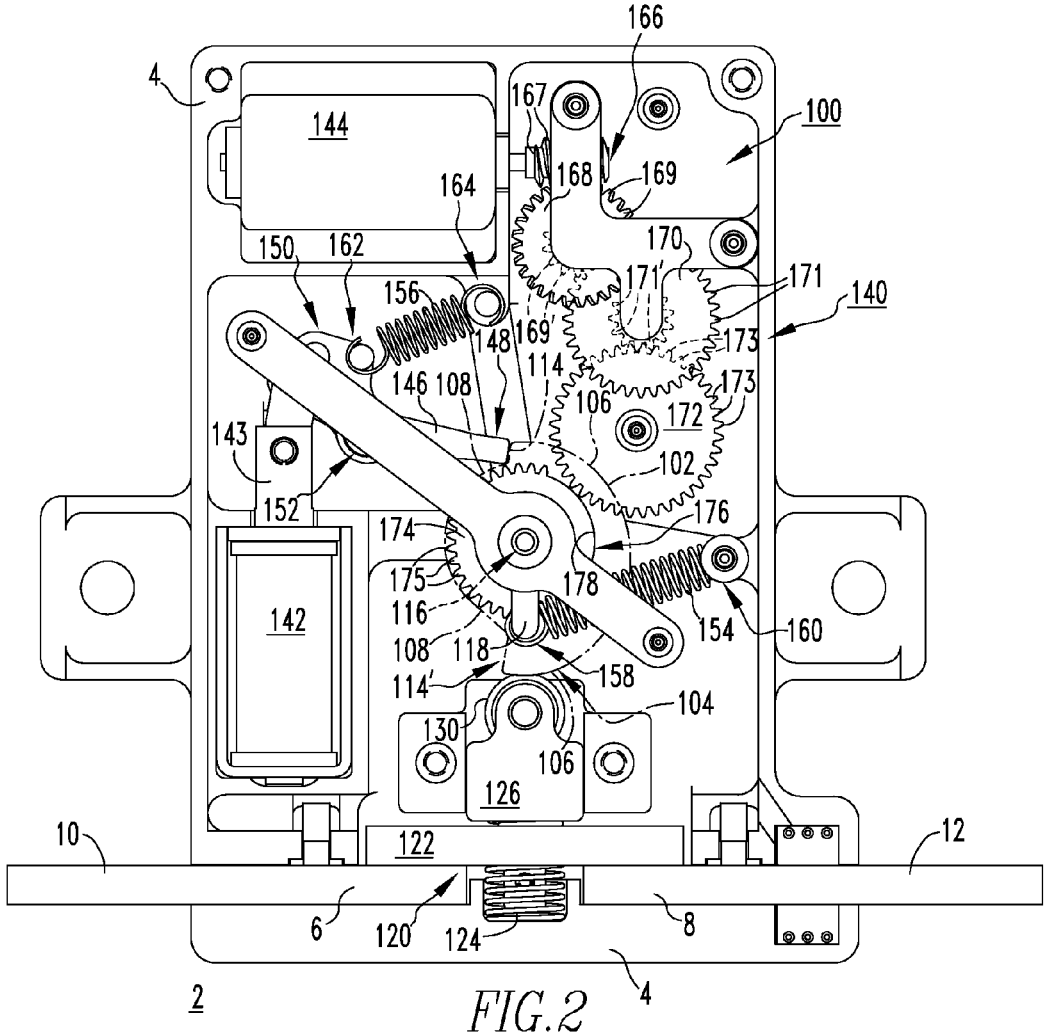
FIG. 2 is a side elevation view of the battery disconnect apparatus and operating mechanism therefor of FIG. 1, with the cover of the housing removed.
Figure 3:
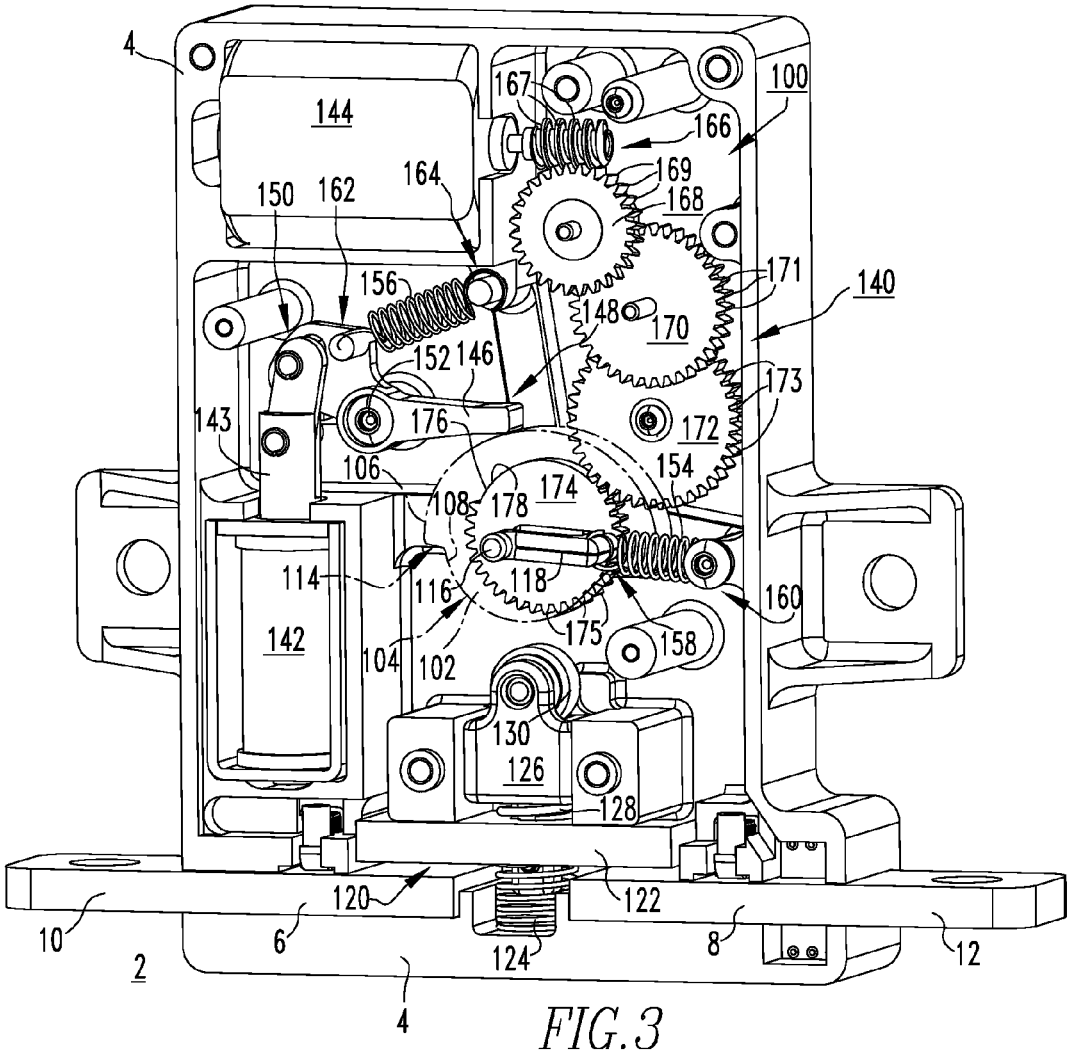
FIG. 3 is an isometric view of the battery disconnect apparatus and operating mechanism therefor of FIG. 1, with the cover of the housing removed and modified to show the operating mechanism in the open position.

FIGS. 1-3 show a battery disconnect apparatus 2 and operating mechanism 100 therefor, which is resistant to shock and vibration experienced by a vehicle (not shown), in accordance with embodiments of the invention. The battery disconnect apparatus 2 includes a housing 4, separable contacts 6,8,122 enclosed by the housing 4 and electrically connected between a direct current (e.g., battery-side (positive)) terminal 10 and a load (e.g., load-side) terminal 12, and the operating mechanism 100, which is structured to open and close the separable contacts 6,8,122. In the example shown and described herein, the separable contacts include a first stationary electrical contact 6 electrically connected to the direct current terminal 10, a second stationary electrical contact 8 electrically connected to the load terminal 12, and a movable contact 122 moved by the operating mechanism 100. The battery terminal 10 is electrically connected to the battery (not shown) of the vehicle (not shown), and the load terminal 12 is disposed opposite and spaced from the battery terminal 10. The separable contacts 6,8,122 are thus arranged in a double break configuration. It will, however, be appreciated that any known or suitable alternative number and configuration of separable contacts (e.g., without limitation, a single-break contact configuration; a mechanically held mechanism) (not shown) could be employed, without departing from the scope of the invention.

Figure 4A:
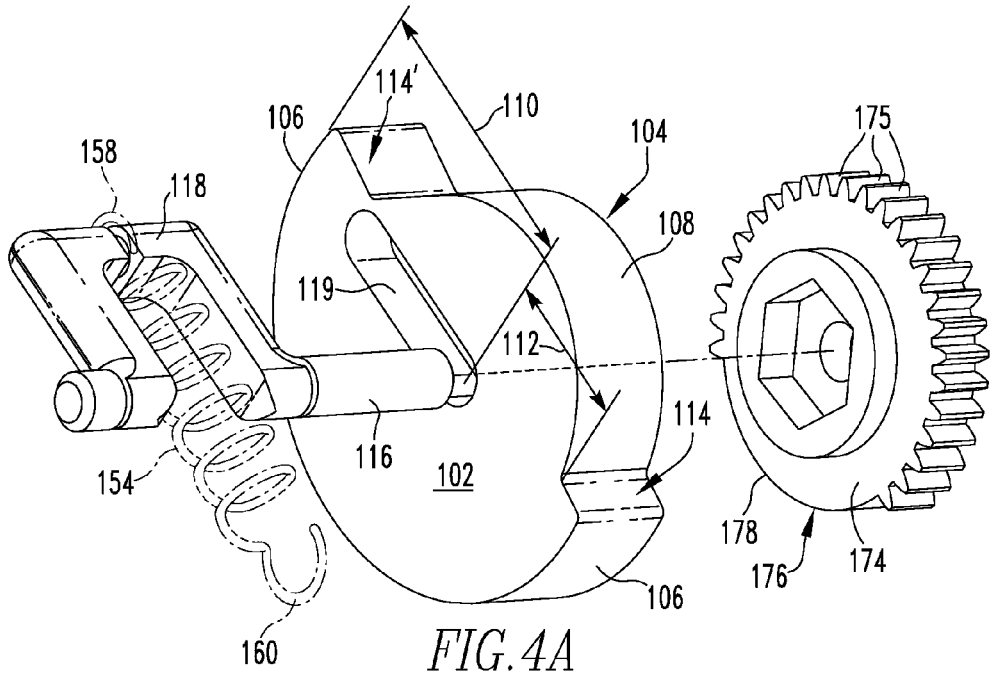
FIGS. 4A and 4B are exploded isometric views of the front and back, respectively, of the cam assembly of the operating mechanism of FIG. 1.
Figure 4B:
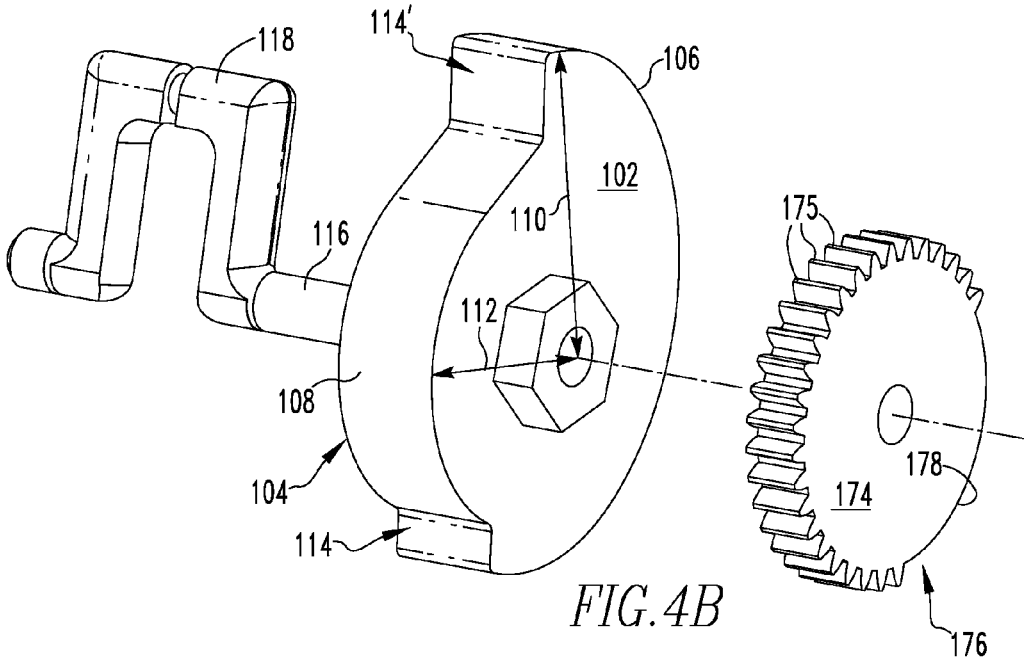

The operating mechanism 100 includes a cam member 102 (shown in phantom line drawing in FIGS. 2 and 3), which is structured to be pivotably coupled to the housing 4, and which includes a profile 104. As best shown in FIGS. 4A and 4B, the profile 104 of the example cam member 102 has a first portion 106 and a second portion 108. The first portion 106 in the example shown in described herein, is a holding portion having a first radius 110, and the second portion 108 is a release portion which includes a second radius 112. The first radius 110 is greater than the second radius 112, and the cam member profile 104 gradually increases in size as it transitions from the first radius 110 to the second radius. The profile 104 also has a number of steps 114,114' (two steps 114,114' are shown), which are formed by the transition from the first radius 110 to the second radius 110.

Referring again to FIGS. 1-3, a movable contact assembly 120, which includes the aforementioned movable electrical contact 122, is structured to cooperate with the cam member 102 in order to move the movable electrical contact 122 into (FIGS. 1 and 2) and out of (FIG. 3) electrical contact with the stationary electrical contacts 6,8. More specifically, as will be discussed in further detail hereinbelow, an actuating assembly 140, which is structured to pivot the cam member 102 between a first position corresponding to the first portion 106 of the profile 104 maintaining the movable electrical contact 122 in electrical contact with the stationary electrical contacts 6,8, is provided, as shown in FIGS. 1 and 2, and a second position corresponding to the second portion 108 of the profile 104 releasing the movable contact assembly 120 in order that the movable electrical contact 122 is movable out of electrical contact with the stationary electrical contacts 6,8 to the position shown in FIG. 3.

The movable contact assembly 120 includes at least one biasing element 124, which is structured to bias the movable electrical contact 122 away from the stationary electrical contacts 6,8 (see, for example, FIG. 3). In the example of FIGS. 1-3, the biasing element 124 comprises an opening spring, which is disposed between the housing 4 of the battery disconnect apparatus 2 and the movable electrical contact 122. The step 114' of the cam member profile 104 enables the spring 124 to move the movable contact assembly 120, including the movable electrical contact 122, toward the second portion 108 of the cam member profile 104 when the first portion 106 of the cam member 102 is pivoted (e.g., counterclockwise from the perspective of FIGS. 1-3) to the position shown in FIG. 3. More specifically, in the first position of FIGS. 1 and 2, the first portion 106 of the cam member profile 104 displaces a movable member 126 of the movable contact assembly 120, thereby moving (e.g., downward with respect to FIGS. 1-3) it and the movable electrical contact 122. The movable electrical contact 122 is thus brought into electrical contact with the stationary electrical contacts 6,8, as shown in FIGS. 1 and 2.

In the example shown and described herein, a roller 130 is disposed on the end of the movable member 126. The opening spring 124 and a second biasing element 128, which in the example of FIG. 3 is a spring, biases the roller 130 toward engagement with the cam member profile 104. Accordingly, the roller 130 facilitates movement of the movable contact assembly 120 with respect to the cam member 102. Specifically, the roller 130 moves from engaging the first portion 106 of the cam member profile 104 when the cam member 102 is disposed in the first position of FIGS. 1 and 2, which is a holding position, to being released by the step 114' of the cam member profile 104 and being biased upwardly (from the perspective of FIGS. 1-3) toward the second portion 108 of the cam member profile 104 to the position shown in FIG. 3.

The actuating assembly 140 includes at least one actuator 142,144 and a latch 146. The example latch 146 is pivotably coupled to the housing 4 (best shown in FIG. 3) and includes a first end 148, a second end 150, and a pivot 152 disposed between the first and second ends 148,150. It will, however, be appreciated that the pivot 152 could be disposed elsewhere on the latch 146 such as, for example, at or about the second end 150. It will also be appreciated that a linear latch (not shown) which translates substantially laterally into and out of engagement with the cam member 102 instead of pivoting, could be employed without departing from the scope of the invention. When the cam member 102 is disposed in the first position (FIGS. 1 and 2), the first end 148 of the latch 146 engages the profile 104 at or about the step 114 thereof, thus preventing the cam member 102 and the movable contact assembly 120 from moving. A first actuator 142, which in the example shown and described herein is a solenoid 142, is structured to move the second end 150 of the latch 146, thereby pivoting (e.g., counterclockwise with respect to FIGS. 1-3) the latch 146 about the pivot 152 in order to disengage the first end 148 from the cam member profile 104, to permit the cam member 102 to pivot.

As will be described hereinbelow, movement of the cam member 102 is provided by the combination of a separate, second actuator, which in the example shown and described herein is a motor 144, and a resilient member 154 (e.g., over-center spring). Thus, in the example shown and described herein, the at least one actuator comprises the solenoid 142 and the motor 144, which perform the separate and distinct functions of moving the latch 146 and turning the cam member 102, respectively. More specifically, the solenoid 142 includes a plunger 143, which is coupled to the latch 146 at or about the second end 150 thereof. Accordingly, the solenoid 142 moves the plunger 143, thereby pivoting the latch 146 and moving the first end 148 thereof out of engagement with the cam member profile 104, as previously discussed. It will, however, be appreciated that the solenoid 142 could be employed to move a suitable linear latch (not shown) laterally, as previously discussed.

The actuating assembly 140 further includes at least one resilient member, such as the first and second resilient members 154,156 shown in FIGS. 1-3 (see also resilient member 154 shown in phantom line drawing in FIG. 4A). The first resilient member 154 in the example shown and described herein, is the aforementioned over-center spring, which includes a first end 158 coupled to the cam member 102, and a second end 160 coupled to the housing 4 of the battery disconnect apparatus 2. Specifically, as best shown in FIGS. 4A and 4B, the example cam member 102 includes a pivot shaft 116 and a crank 118, which extends generally perpendicularly outwardly from the pivot shaft 116. The first end 158 of the first resilient member 154 is coupled to the crank 118 (shown in solid line drawing in FIGS. 1-3; see also first end 158 of resilient member 154, shown in phantom line drawing engaging crank 118 in FIG. 4A). A slot 119 (FIG. 4A) in the cam member 102 receives a portion of the crank 118 in order to resist the pivot shaft 116 and crank 118 from moving independently with respect to the cam member 102. In other words, the crank 118 and cam member 102 are fixed with respect to one another. The first resilient member 154 is, therefore, structured to bias the cam member 102 toward the second position shown in FIG. 3, after it has been charged by the motor 144. Accordingly, as will be discussed in greater detail hereinbelow, the cam member 102, movable contact assembly 120, and actuating assembly 140 not only resist unintentional separation of the movable electrical contact 122 from the stationary electrical contacts 6,8, for example in response to shock and/or vibration loads experienced by the vehicle (not shown), but they also advantageously provide rapid separation (FIG. 3) of the contacts 6,8,122 in the event of a fault condition. It will, however, be appreciated that any known or suitable alternative configuration of the cam member 102, pivot shaft 116 and crank 118, could be employed. For example and without limitation, although the pivot point of the cam member 102 shown and described herein is located at or about the center of rotation of the cam member 102, it could alternatively be offset from the center of rotation to provide any suitable desired pivot motion.

The second resilient member 156 of the example actuating assembly 140 includes a first end 162 coupled to the latch 146 proximate the second end 150 of the latch 146, and a second end 164 coupled to the housing 4 of the battery disconnect apparatus 2. Accordingly, it will be appreciated that the second resilient member 156, which in the example shown and described herein is a spring, biases the latch 146 to engage the cam member profile 104 and, in particular, step 114 of the profile 104, as previously discussed (see FIGS. 1 and 2). Such configuration allows for the use of a relatively small solenoid 142, because it is only necessary for such solenoid to have a unidirectional plunger 143, and only requires the solenoid 142 to perform one function, namely moving (e.g., pulling) the second end 150 of the latch 146 in one direction (e.g., downward from the perspective of FIGS. 1-3). The spring 156 functions to pull the latch 146 in the opposite direction (e.g., toward engagement with the cam member profile 104) as the plunger 143, as previously discussed. In this manner, the size and associated weight of the solenoid 142 can be kept to a minimum as compared, for example, to solenoids, which must provide both pushing and pulling functions. A non-limiting example of a solenoid, which is suitable for use with the disclosed battery disconnect apparatus 2 is the Bicron SD0730N pull-type solenoid available from Bicron Electronics Company, which has a place of business at 50 Barlow Street, Canaan, Conn. 06068. It will, however, be appreciated that any known or suitable solenoid or alternative suitable actuator (not shown) could be employed without departing from the scope of the invention.

In addition to the solenoid 142, the example actuating assembly 140 further includes the aforementioned motor 144, and a plurality of gears 166,168,170,172,174. Among other benefits, the use of the motor 144 and gears 166,168, 170,172,174 provide a slower (as compared to a solenoid only) closing speed for the separable contacts 6,8,122, thereby minimizing undesirable bounce of the movable electrical contact 122 with respect to the stationary electrical contacts 6,8 and disadvantageous arcing issues associated therewith. Such disadvantages can occur, for example, in battery disconnect apparatus, which employ solenoids instead of a motor. By way of example, without limitation, one suitable motor 144, which is a DC motor that is relatively low cost, lightweight and vibration and shock resistant in accordance with embodiments of the invention, is the Mabuchi FC-280SC-20150, which is available from Mabuchi Motor Company, Ltd. having a place of business at 430 Matsuhidai, Matsudo City, Chiba, 270-2280 Japan.

The gears 166,168,170,172,174, which will now be discussed, function to decrease the speed of the motor 144 and increase the torque provided thereby. Specifically, the example actuating assembly 140 includes a drive gear 166 coupled to the shaft of the motor 144, a cam gear 174 coupled to the cam member 102, and a number of reduction gears 168,170,172 therebetween. Each of the gears 166,168, 170,172,174 has a plurality of teeth 167,169,169' (FIG. 2),171,171' (FIG. 2),173,175, which are cooperable in order that all of the gears 166,168,170,172,174 are movable in response to actuation by the motor 144. In this manner, the disclosed gear and motor combination functions to close the separable contacts 6,8,122. By way of a non-limiting example, the aforementioned gear and motor combination functions to turn the cam member 102 at about 43 revolutions per minute (RPM), in order to close the separable contacts 6,8,122 in about 0.7 seconds. It will, however, be appreciated that any known or suitable number and configuration of gears could be employed to provide the desired torque and closing speed.

The cam gear 174, which is best shown in the exploded views of FIGS. 4A and 4B, has a perimeter 176 and a portion 178 that is devoid of teeth (e.g., 175). Accordingly, when the cam member 102 is disposed in the first position, shown in FIGS. 1 and 2, the portion 178 (FIG. 2) of the perimeter 176 (FIG. 2) is structured to disengage the cam gear 174 and cam member 102 from the reduction gears 168,170,172, the drive gear 166, and the motor 144. The cam member 102 is maintained (e.g., locked) in this position by the latch 146, with the first portion 106 of the cam member profile 104 holding the movable electrical contact 122 in electrical contact with the stationary electrical contact 6,8, as previously discussed. Also, in this position (the first position of the cam member 102), the first resilient member 154, which in the example shown and described herein is a spring, is charged (e.g., stretched) and, therefore, is ready to rapidly move the cam member 102 away from the movable contact assembly 120 upon actuation of the solenoid 142, as previously discussed. Such actuation of the solenoid 142 typically occurs in response to a fault condition or a signal from the operator (e.g., without limitation, driver; mechanic) to open the contacts 6,8,122.

Specifically, the absence of teeth 175 on portion 178 of the cam gear perimeter 176 permits the cam member 102 to rapidly rotate (e.g., counterclockwise with respect to FIGS. 1-3), independently with respect to the other gears 166,168, 170,172, to the second position shown in FIG. 3. However, it will be appreciated that such rapid movement could be provided in any suitable manner (e.g., without limitation, the cam member 102 slipping with respect to the cam gear 174). The teeth 175 of the cam gear 174 are then engagable with the teeth 173 of corresponding reduction gear 172. The aforementioned spring 154 facilitates this engagement. In turn, the teeth 173 of that gear 172 are engagable with teeth 171' (shown in hidden line drawing in FIG. 2) of gear 170. Teeth 171 of gear 170 cooperate with gears 169' (shown in hidden line drawing in FIG. 2), and teeth 169 of gear 168 cooperate with teeth 167 of the drive gear 166, which in the example shown and described herein is a worm gear. In this manner, the motor 144 is movable to move the drive gear 166, the reduction gears 168,170,172, and the cam gear 174, thereby moving the cam member 102 (e.g., counterclockwise about 270 degrees with respect to FIG. 3) to engage the roller 130 of the movable contact assembly 120 with the first portion 106 of the cam member profile 104, and lock the cam member 102 in the first position of FIGS. 1 and 2, with the first end 148 of latch 146, as previously discussed. In this manner, the disclosed motor and gear configuration function to effectively close the separable contacts 6,8,122 of the battery disconnect apparatus 2.

Accordingly, the disclosed operating mechanism 100 employs a unique cam member 102, movable contact assembly 120, and actuating assembly 140 to provide a relatively small, lightweight and cost-effective mechanism for effectively operating (e.g., opening and closing) the separable contacts 6,8,122 of the battery disconnect apparatus 2 while resisting arcing hazards commonly associated with shock and vibration loads experienced by a vehicle.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An operating mechanism for a circuit interrupter including a housing and a number of stationary electrical contacts enclosed by said housing, said operating mechanism comprising:

a cam member structured to be pivotably coupled to said housing, said cam member having a profile, said profile having a first portion and a second portion;

a movable contact assembly comprising a movable electrical contact, said movable contact assembly being structured to cooperate with said cam member in order to move said movable electrical contact into and out of electrical contact with said number of stationary electrical contacts; and an actuating assembly structured to pivot said cam member between a first position corresponding to the first portion of said profile being structured to maintain said movable electrical contact of said movable contact assembly in electrical contact with said number of stationary electrical contacts, and a second position corresponding to the second portion of said profile being structured to release said movable contact assembly in order that said movable electrical contact is movable out of electrical contact with said number of stationary electrical contacts.

2. The operating mechanism of claim 1 wherein said movable contact assembly further comprises at least one biasing element structured to bias said movable electrical contact away from said number of stationary electrical contacts; wherein the first portion of said profile has a first radius; wherein the second portion of said profile has a second radius; wherein the first radius is greater than the second radius; wherein said profile comprises a step from the first radius to the second radius; and wherein, when said cam member is moved from said first position toward said second position, said step of said profile is structured to enable said at least one biasing element to move said movable contact assembly toward the second portion of said profile, in order to move said movable electrical contact away from said number of stationary electrical contacts.

3. The operating mechanism of claim 2 wherein said at least one biasing element comprises an opening spring; and wherein said opening spring is structured to be disposed between said housing and said movable electrical contact.

4. The operating mechanism of claim 2 wherein said actuating assembly comprises at least one actuator and a latch; wherein said latch includes a first end and a second end; wherein, when said cam member is disposed in said first position, the first end of said latch engages said profile at or about said step, thereby preventing said cam member and said movable contact assembly from moving; and wherein said at least one actuator is structured to move the second end of said latch, thereby disengaging the first end of said latch from said profile and to permit said cam member to pivot.

5. The operating mechanism of claim 4 wherein said actuating assembly further comprises at least one resilient member; wherein said cam member includes a pivot shaft and a crank extending generally perpendicularly outwardly from said pivot shaft; wherein a first resilient member of said at least one resilient member includes a first end and a second end; wherein the first end of said first resilient member is coupled to said crank; wherein the second end of said first resilient member is structured to be coupled to said housing; and wherein said first resilient member is structured to bias said cam member toward said second position.

6. The operating mechanism of claim 5 wherein said at least one resilient member further comprises a second resilient member; wherein said second resilient member includes a first end and a second end; wherein the first end of said second resilient element is coupled to said latch proximate the second end of said latch; wherein the second end of said second resilient member is structured to be coupled to said housing; and wherein said second resilient member is structured to bias said latch toward engagement with said profile.

7. The operating mechanism of claim 4 wherein said at least one actuator comprises a solenoid; wherein said solenoid includes a plunger; wherein said plunger is coupled to said latch at or about the second end of said latch; and wherein said solenoid is structured to move said plunger, thereby moving the first end of said latch out of engagement with said profile.

8. The operating mechanism of claim 7 wherein said at least one actuator further comprises a motor; wherein said actuating assembly further comprises a plurality of gears; wherein a corresponding one of said gears is coupled to said motor; wherein each of said gears has a plurality of teeth; and wherein, in response to movement of said corresponding one of said gears by said motor, said teeth are cooperable in order that all of said gears are movable.

9. The operating mechanism of claim 8 wherein said gears comprise a drive gear coupled to said motor, a cam gear coupled to said cam member, and a number of reduction gears disposed intermediate said drive gear and said cam gear; wherein said cam gear has a perimeter; wherein a portion of said perimeter of said cam gear is devoid of said teeth; wherein, when said cam member is disposed in said first position, said portion of said perimeter of said cam gear is structured to disengage said cam gear and said cam member from said number of reduction gears, said drive gear and said motor; and wherein, when said cam member is disposed in said second position, said teeth of said cam gear are engagable with said teeth of a corresponding one of said number reduction gears, in order that said motor is movable to move said drive gear, said corresponding one of said number of reduction gears, and said cam gear, thereby moving the first portion of said profile of said cam member into engagement with said movable contact assembly.

10. The operating mechanism of claim 1 wherein said movable contact assembly further comprises a movable member and a biasing element; wherein said biasing element is disposed between said movable electrical contact and said movable member; wherein said movable member is disposed between said biasing element and said cam member;

and wherein said biasing element and said movable member are structured to resist said movable electrical contact from bouncing with respect to said number of stationary electrical contacts.

11. The operating mechanism of claim 10 wherein said movable member comprises a roller; wherein said biasing element is a spring; and wherein said spring biases said roller toward engagement with said profile of said cam member.

12. A circuit interrupter comprising:

a housing;

separable contacts enclosed by said housing, said separable contacts including a number of stationary electrical contacts and at least one movable electrical contact; and an operating mechanism comprising:

a cam member pivotably coupled to said housing, said cam member having a profile, said profile having a first portion and a second portion, a movable contact assembly cooperable with said cam member in order to move said at least one movable electrical contact into and out of electrical contact with said number of stationary electrical contacts, and an actuating assembly structured to pivot said cam member between a first position corresponding to the first portion of said profile maintaining said movable electrical contact of said movable contact assembly in electrical contact with said number of stationary electrical contacts, and a second position corresponding to said movable contact assembly being releasable by the second portion of said profile in order that said at least one movable electrical contact is movable out of electrical contact with said number of stationary electrical contacts.

13. The circuit interrupter of claim 12 wherein said movable contact assembly further comprises at least one biasing element; wherein the first portion of said profile has a first radius; wherein the second portion of said profile has a second radius; wherein the first radius is greater than the second radius; wherein said profile comprises a step from the first radius to the second radius; and wherein, when said cam member is moved from said first position toward said second position, said step of said profile enables said at least one biasing element to move said movable contact assembly toward the second portion of said profile, in order to move said at least one movable electrical contact away from said number of stationary electrical contacts.

14. The circuit interrupter of claim 13 wherein said actuating assembly comprises at least one actuator and a latch; wherein said latch includes a first end and a second end; when said cam member is disposed in said first position, the first end of said latch engages said profile at or about said step, thereby preventing said cam member and said movable contact assembly from moving; and wherein said at least one actuator is structured to move the second end of said latch, thereby disengaging the first end of said latch from said profile and to permit said cam member to pivot.

15. The circuit interrupter of claim 14 wherein said actuating assembly further comprises at least one resilient member; wherein said cam member includes a pivot shaft and a crank extending generally perpendicularly outwardly from said pivot shaft; wherein a first one of said at least one resilient member includes a first end and a second end; wherein the first end of said first resilient member is coupled to said crank; and wherein the second end of said first resilient member is coupled to said housing; and wherein said at least a first resilient member biases said cam member toward said second position.

16. The circuit interrupter of claim 15 wherein said at least one resilient member further comprises a second resilient member; wherein said second resilient member includes a first end and a second end; wherein the first end of said second resilient element is coupled to said latch proximate the second end of said latch; wherein the second end of the second resilient member is coupled to said housing; and wherein said second resilient member biases said latch toward engagement with said profile of said cam member.

17. The circuit interrupter of claim 14 wherein said at least one actuator comprises a solenoid; wherein said solenoid includes a plunger; wherein said plunger is coupled to said latch at or about the second end of said latch; and wherein said solenoid is structured to move said plunger, thereby moving the first end of said latch out of engagement with said profile.

18. The circuit interrupter of claim 17 wherein said at least one actuator further comprises a motor; wherein said actuating assembly further comprises a plurality of gears; wherein a corresponding one of said gears is coupled to said motor; wherein each of said gears has a plurality of teeth; and wherein, in response to movement of said corresponding one of said gears by said motor, said teeth are cooperable in order that all of said gears are movable.

19. The circuit interrupter of claim 18 wherein said gears comprise a drive gear coupled to said motor, a cam gear coupled to said cam member, and a number of reduction gears disposed intermediate said drive gear and said cam gear; wherein said cam gear has a perimeter; wherein a portion of said perimeter of said cam gear is devoid of said teeth; wherein, when said cam member is disposed in said first position, said portion of said perimeter of said cam gear which is devoid of said teeth disengages said cam gear and said cam member from said number of reduction gears, said drive gear and said motor; and wherein, when said cam member is disposed in said second position, said teeth of said cam gear are engagable with said teeth of a corresponding one of said number of reduction gears, in order that said motor is movable to move said drive gear, said corresponding one of said number of reduction gears, and said cam gear, thereby moving said first portion of said profile of said cam member into engagement with said movable contact assembly to close said separable contacts.

20. The circuit interrupter of claim 12 wherein said movable contact assembly further comprises a movable member and a biasing element; wherein said biasing element is disposed between said movable electrical contact and said movable member; wherein said movable member is disposed between said biasing element and said cam member; and wherein said biasing element and said movable member are structured to resist said at least one movable electrical contact from bouncing with respect to said number of stationary electrical contacts.

21. The circuit interrupter of claim 20 wherein said movable member comprises a roller; wherein said biasing element is a spring; and wherein said spring biases said roller toward engagement with said profile of said cam member.

22. The circuit interrupter of claim 12 wherein said circuit interrupter is a battery disconnect apparatus; wherein said number of stationary electrical contacts comprise a battery terminal and a load terminal; wherein said at least one movable electrical contact is a single movable electrical contact; and wherein said battery terminal, said load terminal and said single movable electrical contact are arranged in a double break configuration.

* * * * *